United States Patent [19]

Loschilin et al.

[11] 3,934,619

[45] Jan. 27, 1976

[54] APPARATUS FOR GUIDING WEFT THREAD CARRIERS THROUGH THE SHED OF A LOOM OF THE SUCCESSIVE SHEDDING TYRE

[76] Inventors: Evgeny Dmitrievich Loschilin, Kashirskoe shosse, 36, kv. 87, Domodedovo Moskovskoi oblasti; Alexandr Lvovich Galperin, ulitsa Moldagulovoi, 10, korpus 2, kv. 166, Moscow; Alexandr Alexandrovich Zabotin, ulitsa Profsojuznaya, 96, kv. 85, Moscow; Eduard Arshakovich Onikov, ulitsa Panferova, 5, korpus 2, kv. 106, Moscow; Boris Alexandrovich Sakharov, ulitsa Krzhizhanovskogo, 24/35, korpus 6, kv. 404, Moscow, all of U.S.S.R.

[22] Filed: Oct. 2, 1974

[21] Appl. No.: 511,115

[52] U.S. Cl. ..... 139/12

[51] Int. Cl.[2] ..... D03D 47/26

[58] Field of Search ..... 139/11, 12, 13, 16, 188, 139/196.2

[56] References Cited

UNITED STATES PATENTS

| | | | |
|---|---|---|---|
| 3,729,029 | 4/1973 | Zabrodsky et al. | 139/12 |
| 3,862,648 | 1/1975 | Langr et al. | 139/12 |

*Primary Examiner*—Henry S. Jaudon

*Attorney, Agent, or Firm*—Lilling & Siegel

[57] ABSTRACT

An apparatus for guiding weft thread carriers through successive sheds of a loom of the progressive shedding type includes a closed endless guideway which guides the weft thread carriers through an endless path with the shed forming area comprising only a small part thereof. The closed endless guideway accomodates a moving endless chain conveyor supporting thereon two kinds of members, the members of the first kind cooperating with the thread carriers as they move along this guideway outside the shed, while the members of the other kind cooperate with these carriers as the latter move within the shed. Mounted exteriorly of the guideway in accordance with the shape thereof is a side wall adapted to be engaged by the lateral side of a weft thread carrier and to preclude rotation of this moving weft thread carrier in a horizontal plane.

3 Claims, 6 Drawing Figures

APPARATUS FOR GUIDING WEFT THREAD CARRIERS THROUGH THE SHED OF A LOOM OF THE SUCCESSIVE SHEDDING TYRE

The present invention relates to looms of the progressive shedding or multi-shed type, and, more particularly, it relates to apparatus for guiding carriers of the weft or filling thread through successive sheds of such looms.

There is known in the art of weaving an apparatus for guiding weft thread carriers through successive sheds of a loom of the progressive shedding type, comprising an endless chain conveyor and a closed endless guideway which guides the weft thread carriers through an endless path with the shed forming area comprising only a small part thereof. The closed endless guideway is adapted to accommodate this moving conveyor, the guideway being made up of straight and curving (turnover) portions.

The chain conveyor includes links of two kinds. The links of the first kind are connection links, whereas the links of the other kind serve as members driving the weft thread carriers. The driving links, in turn, have two kinds of members, the members of the first kind being made as retaining members movable in a vertical plane and adapted to be received in the apertures provided in the carriers to drive the latter outside the shed, while the members of the second kind are in the form of rollers adapted to engage the rollers of the carriers to drive the latter within the shed.

One of the curving portions of the guideway is associated with clamping members adapted to press the weft thread carriers against the driving links. The other curving portion of the same guideway accommodates an arrangement for winding the weft thread onto the spools of the carriers.

There are provided at the entrance and exit of the shed, in close proximity thereto, tunnels adapted either to raise or lower the carriers and pressing them against the driving links of the chain conveyor.

Each weft thread carrier has in the lower portion thereof a groove adapted to accommodate the driving link, as the carrier is being driven outside the shed; furthermore, each carrier is provided with a spring-loaded part receivable in this groove to engage the lateral side of the driving link and thus to ensure stability of the weft thread carrier with respect to this driving links.

In operation of the loom, the chain conveyor drives the weft thread carriers through the shed, the carriers being raised above the driving links. As the carriers leave the shed, they get into the lowering tunnel and are lowered onto the driving links, at which point the retaining members project from these driving links to participate in driving the weft thread carriers outside the shed. As the weft thread carriers are displaced further by the conveyor, they enter the curving portions of the guideway whereat the clamping members press from above upon these carriers urging them against the driving links and thus ensuring stability of these carriers. After having passed the curving portion, the weft thread carriers are disengaged from these clamping members and are carried further toward the next curving portion whereat the carriers are pressed against the driving links by the arrangement for winding the weft thread onto the spool of each weft thread carrier.

It can be seen from the above that the known apparatus has a complicated structure, since in order to ensure normal motion of the weft thread carriers along the curving portions of the guideway it necessitates incorporation of the means for pressing the weft thread carriers against the links of the chain, while in order to ensure stable driving of the weft thread carriers along the straight portions of the guideway outside the shed the carriers are to be provided with additional means for securing the carriers with respect to the driving links. The above-mentioned means virtually prevent access to the chain conveyor and complicate visual inspection of the weft thread carriers and their servicing.

There is also known an apparatus for guiding weft thread carriers through successive sheds of a loom of the progressive shedding type, wherein the chain conveyor is concealed within the guideway and drives the weft thread carriers by means of two kinds of members, the members of the first kind being rods adapted to enter through the apertures in the weft thread carriers the internal spaces of the respective spools of these carriers to drive the latter outside the shed, the members of the second kind being in the form of rollers receivable in respective cavities provided in the weft thread carriers.

As the weft thread carriers are being driven by the chain conveyor, they have the bottom side thereof permanently engaging the walls of the guideway throughout the length of the latter. However, in the last-described known apparatus eventual misalignment in mounting as well as unavoidable play in the connection of the rods to the links of the conveyor, however small, are liable to result in displacement of the weft thread carriers from their initial position, as the carriers are moving along the guideway. Such displacement is undesirable, affecting as it does the normal performance of the arrangement for winding the weft thread onto the spools of the weft thread carriers.

It is an object of the present invention to provide an apparatus for guiding weft thread carriers through successive sheds of a loom of the progressive shedding type, wherein the means for guiding the weft thread carriers should be of a simple structure providing for reliable retaining of the carriers being driven along both the straight and curving portions of the guideway, the structure not encumbering the entire apparatus.

These and other objects are attained in an apparatus for guiding weft thread carriers through the successive sheds of a loom of the progressive shedding type, comprising a closed stationary endless guideway which guides the weft thread carriers through an endless path with the shed forming area comprising only a small part thereof. The closed endless guideway has straight and curving portions and an endless chain conveyor accommodated within this guideway and supporting thereon members of two kinds, the members of the first kind being adapted to cooperate with the weft thread carriers as they move within the shed and the members of the other kind being adapted to be received within apertures made in the weft thread carriers as the latter are moving outside the shed along the stationary guideway, in which apparatus, in accordance with the present invention, the stationary guideway has mounted externally thereof a side wall corresponding in shape to the straight and curving portions of this guideway, said side wall serving as a guide for the lateral side of a weft thread carrier and having at the curving portions thereof an L-shaped profile, one end of this profile being secured to this guideway and the other free end thereof facing the weft thread carriers, the lateral side of each weft thread carrier, adapted to engage this side wall, having made therein an arcuate groove intended to receive the free end of the side wall, as the weft thread carrier is moving along the curving portions of the guideway.

With the side wall being mounted on the stationary guideway it is possible to rid the apparatus of the tunnel intended to lower the weft thread carriers onto the driving links, as well as of specific elements retaining each carrier on this driving link, because in the herein disclosed apparatus stable positioning of the moving weft thread carriers is effected owing to the joint action of the guideway which the weft carrier engages by the bottom side thereof and of the side wall cooperating with the lateral side of each weft carrier.

The L-shaped cross-sectional profile of the side wall at the curving portions thereof enables the means pressing the weft thread carriers against the links of the chain to be eliminated, because the free end or limb of the side wall received in the arcuate groove in the weft thread carrier precludes both displacement of the latter in a vertical plane and any eventual oscillation of the same in a horizontal plane, which considerably simplifies the structure of the means that are necessary to retain each weft carrier in a particular position with respect to the chain conveyor. Besides, the above-mentioned side wall does not prevent access either to the guideway or to the chain conveyor with the weft thread carrier, which is essential for maintenance of the loom.

Since the above-mentioned side wall acts as a guide for the lateral side of the weft thread carriers, it becomes possible to make the members driving the weft thread carriers outside the shed in the form of cylindrical rods, which, in turn, enables the connection of the spool to the weft thread carrier to be simplified and fouling of the spool to be minimized.

In accordance with one feature of the present invention, the arcuate groove of the weft thread carrier is concentric with the arc of the free end or limb of the side wall at the curving portion thereof, the depth of the groove being minimal at a point opposing the aperture in the weft thread carrier and being substantially equally spaced from the ends of the groove. This feature provides for reliable retaining of the specified position of the weft thread carriers with respect to the guideway, as the carriers are moving along the curving portion of the guideway.

In accordance with another feature of the present invention, the curving portions of the side wall are separated from the straight portions thereof, the ends of the latter being bent outwardly. This feature enables the weft thread carriers to rotate in a horizontal plane, as the carriers pass from the straight portions of the guideway onto the curving ones.

Thus, the herein disclosed apparatus for guiding weft thread carriers is of a simple structure minimizing the eventuality of malfunctioning, providing for easy access to any part of the apparatus and ensuring reliable retaining of the weft thread carriers moving along the curving portions of the guideway. All this permits of considerably increasing the overall productivity of a weaving loom.

Given hereinbelow is a detailed description of an apparatus embodying the present invention, with reference being made to the accompanying drawings, wherein.

Figure 1:
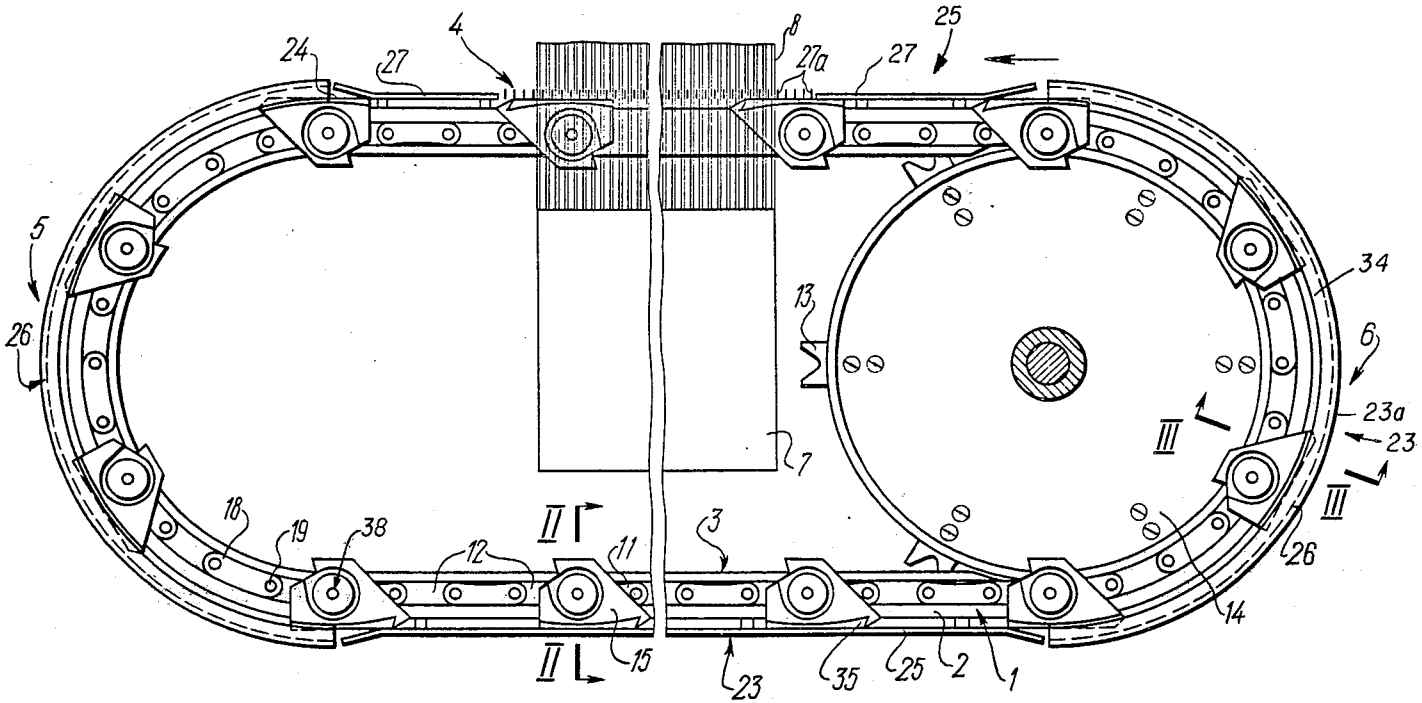
FIG. 1 is a plan view of an apparatus for guiding weft thread carriers, in accordance with the invention.

Referring now in particular to the appended drawings, the apparatus for guiding weft thread carriers through successive sheds of a loom of the progressive shedding type includes an endless chain conveyor 1 (FIG. 1) and a closed endless stationary guideway 2 within which the conveyor 1 is adapted to move, the guideway 2 including straight portions 3 and 4 and curving portions 5 and 6 shaped as arcs of the same radius.

The stationary guideway 2 is arranged so that the curving portions 5 and 6 are positioned at the opposite sides of the associated loom (not shown), the straight portion 3 being positioned above the already woven cloth 7 and the straight portion 4 underlying the warp threads 8 of which the shed is formed.

Figure 2:
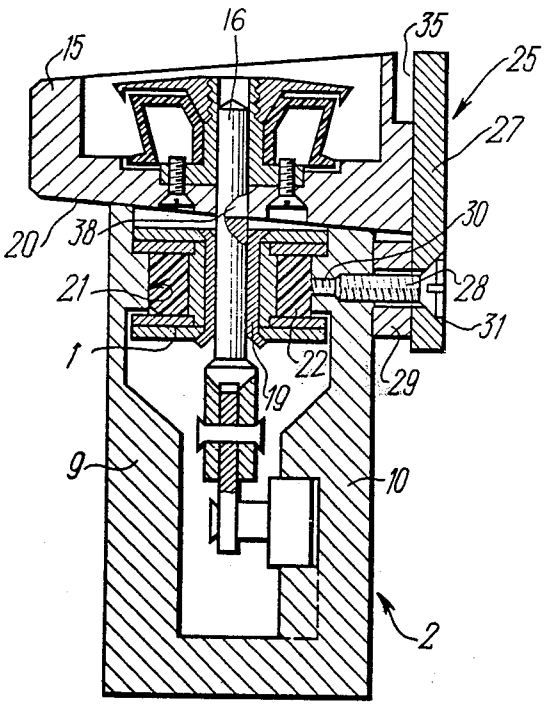
FIG. 2 is a sectional view along line II — II of FIG. 1.

The guideway 2 (FIGS. 2 and 3) is U-shaped in cross-section, its vertical walls 9 and 10 being of different height, the wall 9, forming the internal side of the guideway, being higher than the other wall 10 thereof, forming the external side.

The guideway 2 accommodates, intermediate of the walls 9 and 10 thereof, the chain conveyor 1 having the commonly known sleeve-and-roller structure and including interconnected links 11 and 12 (FIG. 1). The conveyor 1 is adapated to be driven by teeth 13 provided on the disc of an arrangement 14 for winding the thread onto the spools of weft thread carriers 15, the arrangement being disposed along the arcuate portion 6 of the guideway 2.

The chain conveyor 1 is intended to drive the weft thread carriers 15 both inside and outside the shed along the guideway 2. The carriers are retained with respect to the chain of the moving conveyor by two kinds of members of which the first kind is made as a rod mounting linkage, to be described below, 16 (FIG. 4) supported by the link 12, and the second kind is in the form of a roller 17 carried by the link 11. The rods 16 are intended to retain the carriers 15 as the latter are moving outside the shed, whereas the rollers 17 are intended to retain the weft thread carriers 15 while they are moving within the shed.

The links 11 and 12 (FIG. 1) of the chain conveyor 1 have the same length and are interconnected with pins 18 and 19. There are also provided conventional connecting links which lack both rods 16 and rollers 17 and which define the space between the carriers 15. Depending on the space between the carriers, the number of such conventional or spacer links can be from zero to two. Thus, the distance between the carriers will be defined by the sum of the lengths of one link 11, one link 12 and a certain number of conventional or spacer connecting links.

The conveyor 1 (FIG. 2) is concealed within the guideway 2 so that the carrier 15 has its bottom side 20 bearing upon the walls 9 and 10 of the guideway 2 throughout the length of the latter. To retain the conveyor 1 within the guideway 2 at the same level, the walls 9 and 10 are provided with inwardly oriented shoulders 21 engaged by travelling horizontal followers 22 of the chain received about the pins 18 and 19.

According to the invention, externally of the guideway 2 (FIG. 1), in conformity with the shape of its straight portions 3, 4 and curving portions 5, 6, there are mounted side walls 23 serving as guides for a lateral side 24 of each weft thread carrier 15 which is parallel to the straight portions 3 and 4. The side wall 23 is made up of straight portions 25 and curving portions 26, the portions 25 and 26 being separated from one another and the extremities or ends of the straight portions 25 being bent outwardly, which enables each successive weft thread carrier 15 to rotate in a horizontal plane, as it passes from the straight portions 3 and 4 of the guideway 2 onto the curving portions 5 and 6, respectively, thereof.

The side wall 23 is at the straight portions 25 in the form of a vertically arranged strip 27 (FIG. 2) one end of which is secured externally to the wall 10 of the guideway 2 with a screw 28. The weft thread carrier 15 is wider in cross section than the guideway 2, the strip 27 being fixed in a required vertical position with the help of a spacer 29 interposed between the wall 10 and the strip 27, the spacer 29 having therein an aperture for the passage of the screw 28 screwed into the threaded opening 30 in the wall 10. The strip 27 has a tapered through bore 31 accommodating the countersunk head of the screw 28.

In the area of the shed of the loom, the strip 27 is in the form of a plurality of separate plates 27*a* spaced from one another in the nature of a reed to accommodate the warp threads 8 therebetween. The ends of strip 27 are bent outwardly to enable rotation of carrier 15 in the horizontal plane as it passes from the straight portions 3 and 4 of the guideway 2 to its curving portions 5 and 6.

As suggested above, at the straight portion 4 of the guideway, i.e., in the zone of the warp threads 8 (FIG. 1) the strip is made in the form of separate plates or a reed 27*a*.

Figure 3:
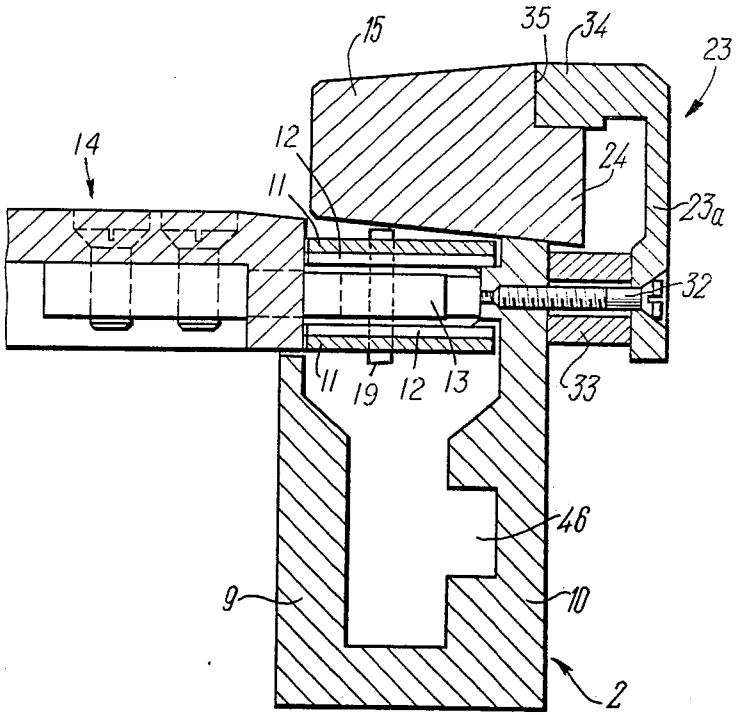
FIG. 3 is a sectional view along line III — III of FIG. 1.

The curving portions 26 of the side wall 23 are in the form of plates 23*a* having an L-shaped profile in cross-section, as can be seen in FIG. 3. One end or limb of the plate 23*a* is secured to the wall 10 of the guideway 2 by a screw 32 through a spacer 33 while the other free end or limb 34 faces the weft thread carriers 15.

Figure 5:
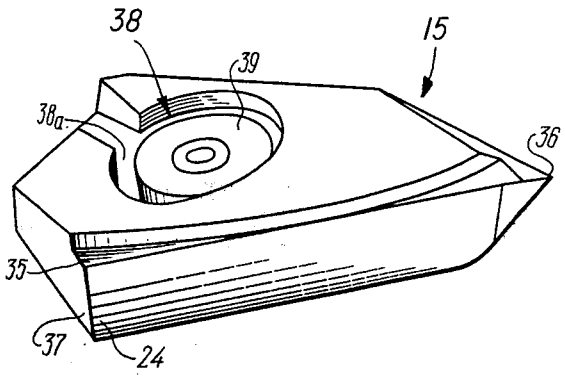
FIG. 5 is a perspective view of a weft thread carrier.

The lateral side 24 of the weft thread carrier 15, cooperating with the side wall 23, has made therein an arcuate groove 35 (FIG. 5), this groove 35 being of a varying depth, i.e., the central portion of the groove 35 has a smaller depth than that of the portions of this groove, adjoining, respectively, a nose 36 and a rear wall 37 of the carrier. The groove 35 (FIG. 3) is intended to accommodate the free end or limb 34 of the side wall 23, while the weft thread carrier 15 is moving along the curving portions 5 and 6 of the guideway 2, the arcuate groove 35 being concentric with the arc formed by the free end or limb 34 of the side wall 23 along the curving portions 26 of the latter. The point of the groove 35 (FIG. 5) whereat its depth is minimal is substantially equally spaced from the ends of the groove and is situated in opposition to the aperture 38 (FIG. 2) in the weft thread carrier 15.

The top side of the weft thread carrier 15 (FIG. 5) has a cavity 38*a* made therein to accommodate a spool 39 with the weft thread left thereon, whereas the bottom side 20 (FIG. 4) of the carrier 15 has made therein a cavity 40 adapted to receive the roller 17 intended to retain the carrier 15 and to drive it through the shed.

The rod 16 is of cylindrical shape and has its lower end pivotally connected to one arm of a bell crank 41 having its central portion pivotally mounted on a bracket 42 mounted on the link 12. The rod 16 extends through the respective pin 19 interconnecting the links 11 and 12, the upper end of the rod 16 being adapted to project, as the rod 16 is vertically reciprocated in operation, through the aperture 38 in the carrier 15 and thus to enter the internal space 43 of an axle 44 which is mounted in the cavity 38*a* of the carrier 15 and is adapted to have a spool 39 received thereabout. In this way, fouling of the spool 39 with lint, dust, etc. is eliminated, since, as the rod 16 enters the internal space 43 of the axle, it ousts the lint, etc. in the upward direction.

Figure 4:
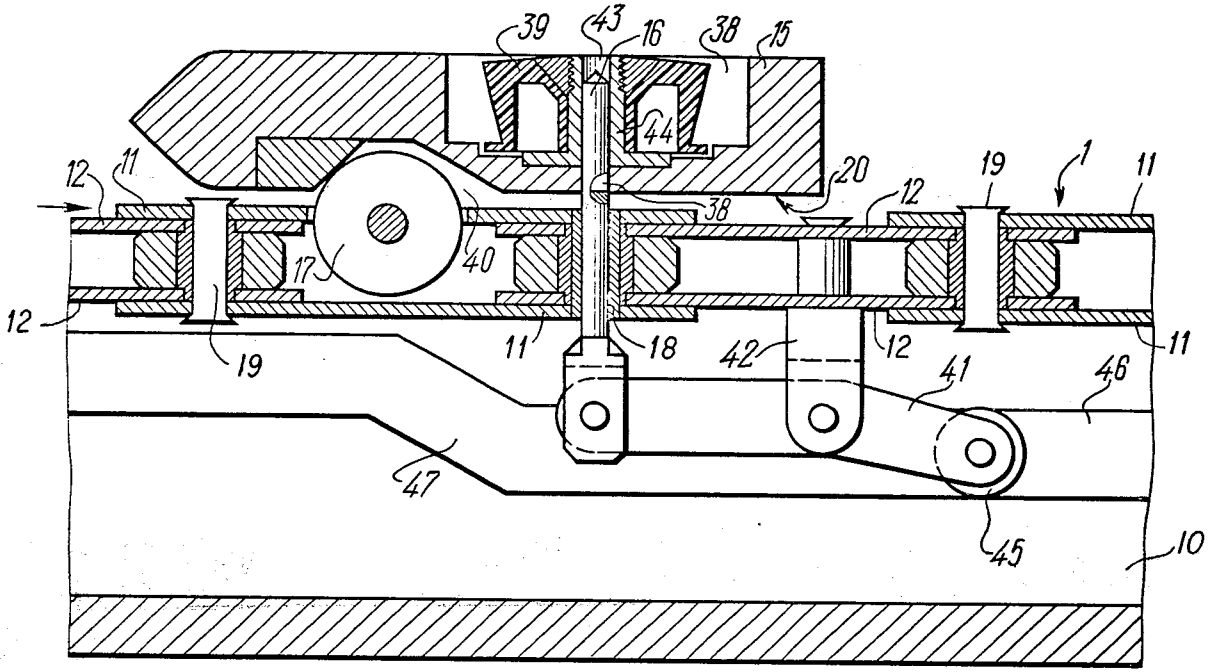
FIG. 4 is a longitudinally sectional view illustrating the position of a weft thread carrier being driven outside the shed.
Figure 6:
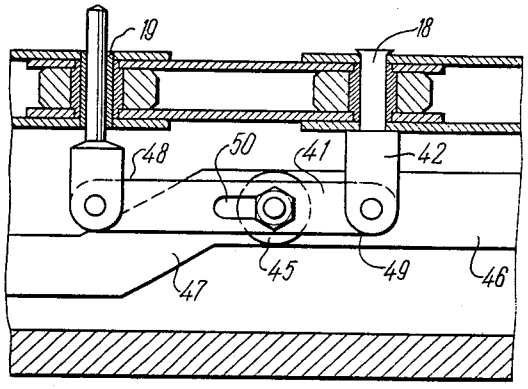
FIG. 6 shows an embodiment of the means for displacing the rod in a vertical plane, a partly longitudinal section view.

The other free arm of the bell crank 41 carries a rotatable follower 45 received in a cam groove 46 provided in the side wall 10 (FIG. 3) of the guideway 2. This cam groove 46 has protions extending at different levels, i.e., the rod-raising and rod-lowering portions interconnected with inclined portions or fileds 47 (FIGS. 4 and 6). As the conveyor 1 is moving in operation, the follower 45 rolls along the groove 46 and follows its successive portions, pivoting the bell crank 41 relative to the bracket 42, whereby the rod 16, respectively, is raised to its topmost position, to enter the axle 44 of the carrier 15 and retain the latter, and lowered, to clear this axle 44 of the carrier 15.

Alternatively, the bell crank 41 may be of a different structure, with the rod 16 (FIG. 6) being pivotally attached to one arm 48 thereof, the other arm 49 being pivotally connected with the bracket 42, the latter being connected with the pin 18 interconnecting the links 11 and 12. The follower 45 adapted to roll along the groove 46 is mounted centrally of the bell crank 41, in a slot 50 provided in the latter. The slot 50 is elongated for displacement therealong of the axle of the follower 45, in which way adjustment of the height of raising of the rod 16 is provided for.

The weft thread carriers are guided by the herein disclosed apparatus as follows.

As a loom of the progressive shedding type, incorporating the apparatus, starts to operate, the arrangement 14 (FIG. 1) for winding the weft thread onto the spools of the carriers effects rotation of the disc thereof, the teeth 13 of the latter engaging the pins 18 and 19 of the links 11 and 12 and thus imparting motion to the conveyor 1 within the guideway 2. With the conveyor 1 (FIG. 2) moving within the guideway 2, the carriers 15 are driven by the rods 16, the carriers 15 riding atop the walls 9 and 10 of the guideway 2. The rods 16 are raised to their topmost position and enter the apertures 38 of the respective carriers 15, the followers 17 (FIG. 4) likewise being in the raised position and entering the cavities 40 of the respective carriers 15 (it should be noted that as the carrier 15 is being driven outside the shed, it is absolutely immaterial whether the roller 17 enters this cavity or not, since it actually takes no active part in driving the weft thread carrier 15 outside the shed).

As the successive ones of the carriers 15 approaches the shed, the follower 45 on the bell crank 11 engages the rod-lowering portion of the cam groove 46 and retracts the rod 16 from the carrier, whereby the latter is further driven through the shed by the roller 17.

When the carrier 15 leaves the shed the follower 45 (FIGS. 4 and 6) lowers, following the respective portions of the cam groove 46 and rotates the bell crank 41, whereby the latter is pivoted into its inclined position, raising the rod 16 mounted on the first arm thereof, for this rod to enter the internal space 44 of the axle of the carrier 15.

In this position, the carriers 15 are driven by the conveyor 1 along the guideway 2, along an endless path with the shed forming area comprising only a small part thereof, the carriers 15 maintaining their strictly oriented positions, since the orientation or indexing of each weft thread carrier 15 is effected on either side thereof, viz. on the bottom side 20 (FIG. 2) along which the carrier bears upon the walls 9 and 10 of the guideway 2 and on the lateral side wall 24 of the carrier 15, engaging the side wall 23. As the carrier 15 (FIG. 1) passes onto the curving portion 5 or 6 of the guideway 2, the carrier is rotated in a horizontal plane through a small angle, owing to the curvilinearity of these portions, the outwardly bent ends of the straight portions 25 of the side wall 23 preventing jamming of the carrier 15. Upon the carrier 15 having entered the curvilinear portion 5 or 6 of the guideway, the free end or limb 34 of the side wall 23 at the curving portion 26 thereof enters, in turn, the arcuate groove 35 of this carrier, and the normal position of the latter is restored, since in this case the carrier 15 is retained, too, in a strictly oriented position by the cooperation of the walls of the groove 35 with the surface of the free end or limb 34 of the side wall 23, as well as by cooperation of the bottom side 20 of the carrier with the guideway 2. The cooperation of this kind is maintained throughout the travel of the weft thread carrier, be it within the shed or outside the same.

What is claimed is:

1. An apparatus for guiding weft thread carriers through the successive sheds of a loom of the progressive shedding type, comprising: an encless chain conveyor including a plurality of interconnected links; first members mounted on some of said links and adapted to cooperate with said weft thread carriers for driving same within the shed of said loom; other members mounted on other ones of said links and adapted for cooperation with said weft thread carriers for driving same outside said shed; a stationary substantially closed endless guideway accommodating said endless chain conveyor for travel therealong and including straight and curving portions, said weft thread carriers moving in operation along said guideway; a side wall mounted externally on said guideway, including straight and curving portions corresponding in shape to said respective straight and curving portions of said guideway, said side wall serving as a guide for the lateral side of each said weft thread carrier, said side wall at said curving portions thereof being L-shaped in cross section, one end thereof being mounted on said guideway so that the free end thereof faces said weft thread carrier; an arcuate groove made in the lateral side of each said weft thread carrier adapted to cooperate with said side wall, said groove being adapted to receive said free end of said curving portion of said side wall as said weft thread carrier moves during operation along said respective curving portions of said guideway.

2. An apparatus as claimed in claim 1, wherein said weft thread carriers have apertures therein for receiving a spool with the weft thread thereon, and wherein said arcuate groove of said weft thread carrier is concentric with the arc formed by said free end of said side wall at said curving portions thereof, the depth of said groove being minimal at a point which is opposite to the aperture in said weft thread carrier and substantially equally spaced from the ends of said groove.

3. An apparatus as claimed in claim 1, wherein said curving portions of said side wall are separated from said straight portions thereof, the latter having their ends bent outwardly.

* * * * *